US007316582B2

(12) United States Patent
Fan

(10) Patent No.: US 7,316,582 B2
(45) Date of Patent: Jan. 8, 2008

(54) PILED-UP AUDIO-SOURCE SOCKET

(75) Inventor: Shih-Ching Fan, Taipei (TW)

(73) Assignee: Wonten Technology Co., Ltd. (TW)

( * ) Notice: Subject to any disclaimer, the term of this patent is extended or adjusted under 35 U.S.C. 154(b) by 109 days.

(21) Appl. No.: 10/909,812

(22) Filed: Aug. 3, 2004

(65) Prior Publication Data

US 2006/0030222 A1 Feb. 9, 2006

(51) Int. Cl.
*H01R 13/66* (2006.01)

(52) U.S. Cl. ..... 439/540.1

(58) Field of Classification Search ..... 439/540.1, 439/701, 717, 532
See application file for complete search history.

(56) References Cited

U.S. PATENT DOCUMENTS 5,014,163 A * 5/1991 Lin ..... 361/796
5,251,106 A * 10/1993 Hui ..... 361/744
5,839,922 A * 11/1998 Orlando et al. ..... 439/717
6,179,653 B1 * 1/2001 Cheng et al. ..... 439/541.5

* cited by examiner

*Primary Examiner*—Khiem Nguyen
(74) *Attorney, Agent, or Firm*—Lowe Hauptman Ham & Berner, LLP

(57) ABSTRACT

A piled-up audio-source socket includes plural socket units and at least a connecting member, and each is provided on each side thereof with a first engaging portion, each connecting member is provided on its two mutually opposite sides each with a second engaging portion; the connecting member renders the socket units to assemble in a vertical orientation or a horizontal orientation. Or two mutually neighboring sides of a socket unit are provided each with a protruding engaging rail, and the remaining two sides are provided each with an engaging groove; an engaging rail on one side of a socket unit can be engaged into an engaging groove on a side of another socket unit. The plural socket units can thus be connected and arranged to form various shapes to suit various types of computers and AV equipments.

1 Claim, 8 Drawing Sheets

PILED-UP AUDIO-SOURCE SOCKET

BACKGROUND OF THE INVENTION

1. Field of the Invention

The present invention is related to a piled-up audio-source socket, and especially to an audio-source socket with a plurality of socket units which each is provided on each side thereof with an engaging means, so that mutually neighboring socket units can be flexibly connected and arranged to form various shapes, it suits various types of computers and AV equipments.

2. Description of the Prior Art

By popular requirements of people for multimedia techniques, a mainframe of a computer or an AV equipment normally is provided with a sound-effect transmitting socket; the socket can form electric connection after insertion of different sound-effect connectors, so that digital data can be converted into analog signals and delivered to horns for emitting sounds, and for transmitting and amplifying other sound sources.

FIG. 7 depicts a conventional three-hole type socket structure "a", it is generally connected to a printed-circuit board of a mainframe of a computer; the socket structure "a" has on the top thereof three annular heads "b" for insertion of different sound-effect connectors, one end of each annular head "b" is combined with a plastic main body "c" of the socket structure "a"; when the sound-effect connectors are inserted, the electrodes provided in the connectors and a plurality of electric conductive terminals "d" in the socket structure "a" are mutually correspondingly connected, this can achieve an effect of signal transmission.

The plastic main body "c" of the socket structure "a" is formed by piling of different components, these components must be separated given with different molds, this not only makes time wasting in piling connection, but also does not meet the requirement of economic results because of the need of developing plural molds.

As shown in FIG. 8, to solve the above stated problems, manufacturers in the art connect three socket units f1, f2 and f3 into a socket structure "e", and each plastic main body "g" of the three socket units f1, f2 and f3 is formed integrally. The three socket units f1, f2 and f3 each has one side provided with a groove "h", the first and the second socket units f1, f2 are further provided each with a protruding portion "k", the third socket unit f3 does not have on the other side thereof the abovementioned protruding portion "k". Thereby, the protruding portion "k" of the first socket unit f1 can be engaged in the groove "h" of the second socket unit f2, while the protruding portion "k" of the second socket unit f2 can be engaged in the groove "h" of the third socket unit f3 to thereby form longitudinal connection. The socket structure "e" can solve the above stated problem of developing plural molds; there are still some other problems to be solved though:

1. When the sequence of the socket units is changed, by virtue that the third socket unit f3 does not have on the other side thereof a protruding portion "k", it can not be simultaneously connected with the first and the second socket units, and difficulty of assembling is resulted, thereby a conventional socket structure must be completely assembled following a predetermined sequence, and is lack of flexibility.
2. In assembling the socket units, they can only be connected in a longitudinal arrangement, and are unable to be connected in a transverse way or in other different shapes, when they are applied on circuit boards of different equipments, the circuits and electronic elements on the circuit boards must be arranged in accordance with the given mode of arrangement of the socket units; such rigid structures in fact are unable to generally suit various types of computers and AV equipments.

SUMMARY OF THE INVENTION

In view of these, in order to get rid of the above defects to make piled-up audio-source sockets neighboring to one another not only be able of mutual connecting, but also able of flexibly arranged and connected to form various shapes, for the purpose of being applicable for various types of computers and AV equipments, the inventor provides the present invention after nonstop study and development.

The primary object of the present invention is to provide a piled-up audio-source socket of which a plurality of socket units each is provided on each side thereof with an engaging means, so that mutually neighboring socket units can be mutually connected, and so that the socket units can be flexibly connected and arranged to form various shapes in pursuance of the requirements of various types of computers and AV equipments.

The secondary object of the present invention is to provide an improved structure of a sound-effect socket of which all socket units have identical structures, this can reduce the cost of assembling and mold developing in production.

To achieve the above stated objects, a piled-up audio-source socket provided for the present invention is for connecting onto a printed-circuit board and includes a plurality of socket units and at least a connecting member, the socket units each is provided on each side thereof with a first engaging portion, every connecting member is provided on two mutually opposite sides thereof each with a second engaging portion. The connecting member can render the socket units to assemble in a vertical orientation or a horizontal orientation.

The first engaging portion of each socket unit of the audio-source socket can be an engaging groove, while the second engaging portion of the connecting member is an engaging rail; or the first engaging portion of each socket unit is an engaging rail, while the second engaging portion of the connecting member is an engaging groove. And two mutually neighboring sides of a socket unit can be provided each with a protruding engaging rail, and the remaining two sides are provided each with an engaging groove; an engaging rail on one side of a socket unit can be engaged into an engaging groove on a side of another socket unit. With the above stated three different embodiments, plural socket units can be connected and arranged to form various shapes.

The present invention will be apparent after reading the detailed description of the preferred embodiment thereof in reference to the accompanying drawings.

DETAILED DESCRIPTION OF THE PREFERRED EMBODIMENT

Figure 1:
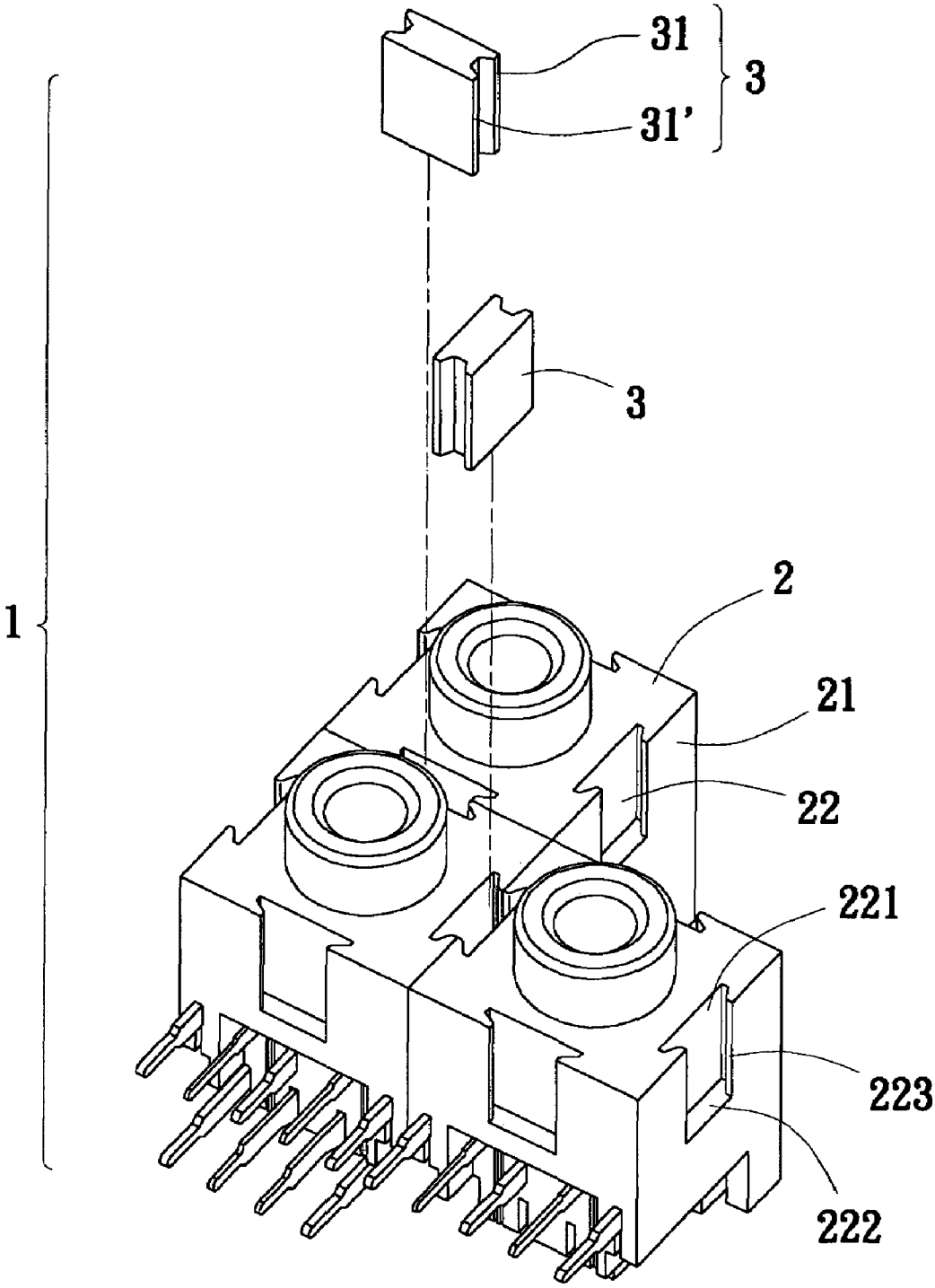
FIG. 1 is an exploded perspective view showing the elements in a first embodiment of the present invention.

Referring to FIG. 1 showing a first embodiment of piled-up audio-source socket 1 of the present invention, the audio-source socket 1 is connected onto a printed-circuit board (not shown) and includes a plurality of (there are three in this embodiment) socket units 2 and a plurality of (there are two in this embodiment) connecting members 3.

The socket units 2 each is provided on each of four sides 21 thereof with a dovetail like engaging groove 22 being a first engaging portion; the upper end of the engaging groove 22 has an insertion slot 221, and the lower end of the latter has a stop portion 222, the engaging groove 22 has on the outer mouth thereof an area-reduced portion 223.

The connecting members 3 each is in an "H" shape, two mutually opposite sides of it each has two engaging rails 31, 31' in symmetrical allocation forming a shape of a dovetail being a second engaging portion. The connecting member 3 is contracted in the middle portion thereof for the purpose of connecting with area-reduced portions 223 of engaging grooves 22.

Figure 2:
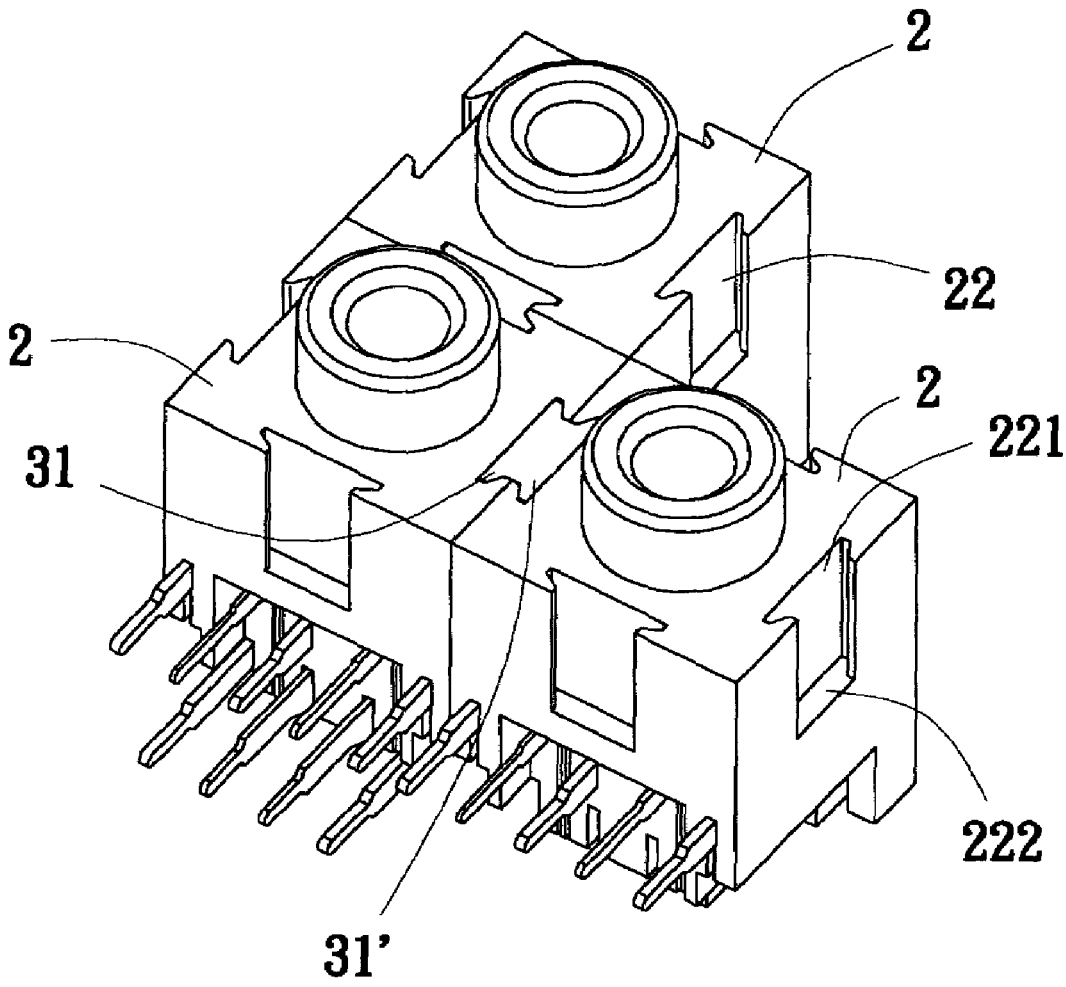
FIG. 2 is a perspective view showing the appearance of the first embodiment of the present invention.

Referring to FIG. 2, when two mutually neighboring socket units 2 are connected with each other, to insert the engaging rails 31, 31' on the two sides of a connecting member 3 into the insertion slots 221 on the upper end of the socket units 2 until their stop portions 222, the engaging rails 31, 31' will respectively connected with the interior of the engaging grooves 22, and in turn the two socket units 2 are connected with each other. When three socket units 2 are connected and arranged in an "L" shape, two connecting members 3 are respectively connected with two mutually neighboring sides 21 of a socket unit 2, in order that they can be connected with the other two socket units 2.

Figure 3:
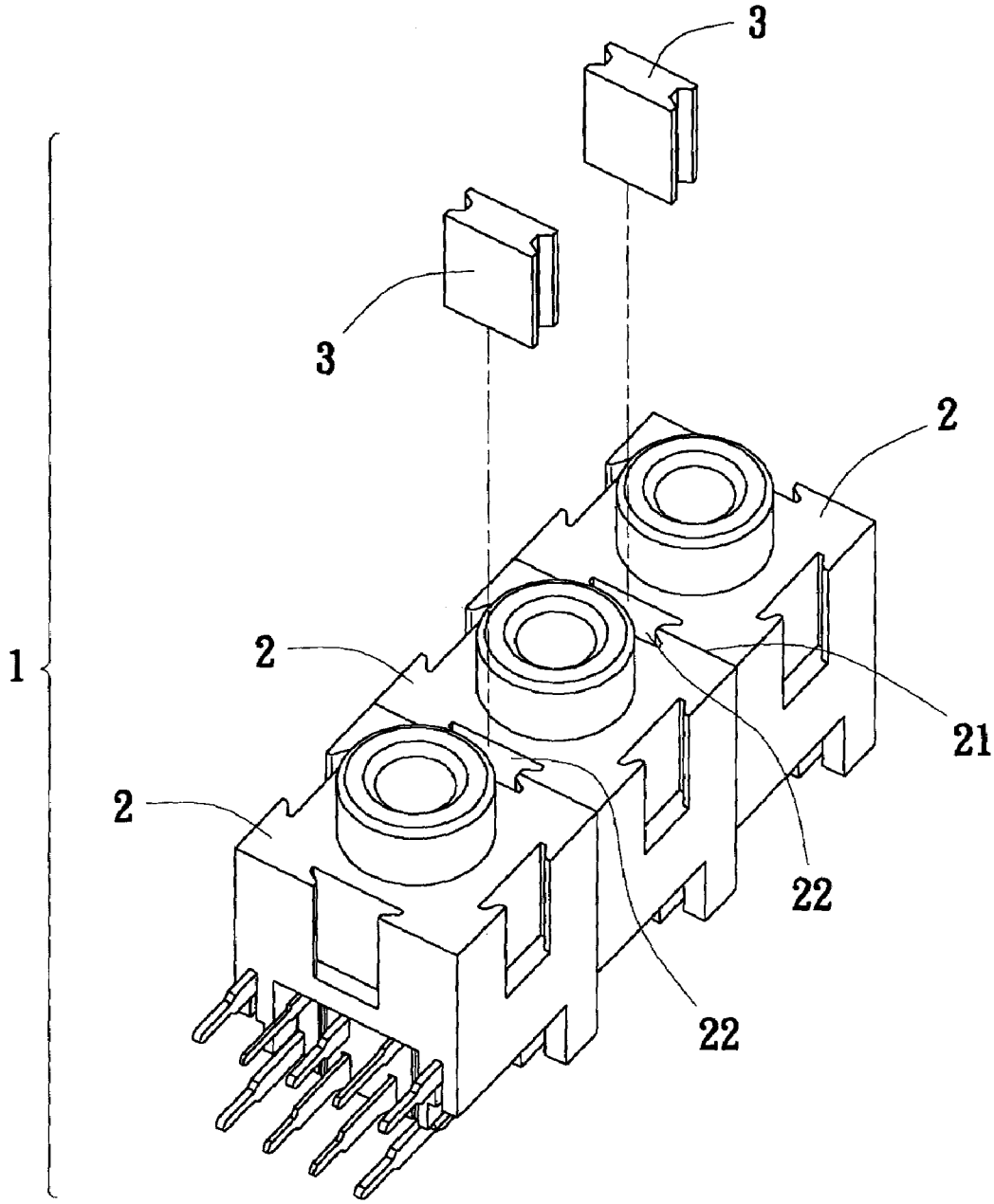
FIG. 3 is an exploded perspective view showing the elements in the first embodiment linearly arranged of the present invention.

Referring to FIG. 3, when two connecting members 3 are engaged respectively with two engaging grooves 22 on two mutual opposite sides 21 of a socket unit 2, then they can be engaged respectively with the other two socket units 2 neighboring to them to be arrayed in a straight line. After connection of the above stated three socket units 2, the mutually neighboring sides 21 of every two mutually neighboring socket units 2 can be directly abut-connected with each other; so that the outer periphery of the audio-source socket 1 can have flush surfaces.

Figure 4:
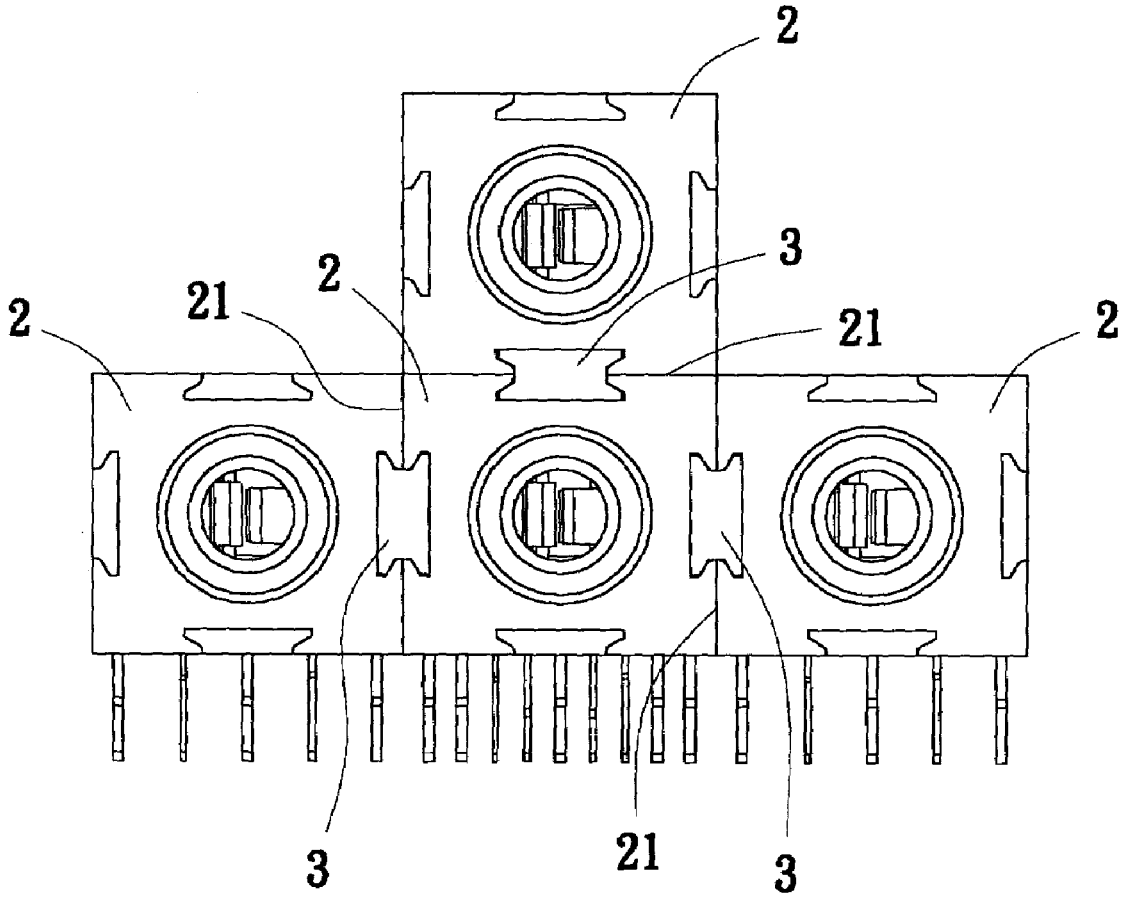
FIG. 4 is a top view showing the first embodiment arranged in a "T" shape of the present invention.

Referring to FIG. 4, when three connecting members 3 are engaged respectively with three engaging grooves 22 on three sides 21 of a socket unit 2, then they can be engaged respectively with the other three socket units 2 neighboring to them to be arrayed in a "T" shape.

Figure 5:
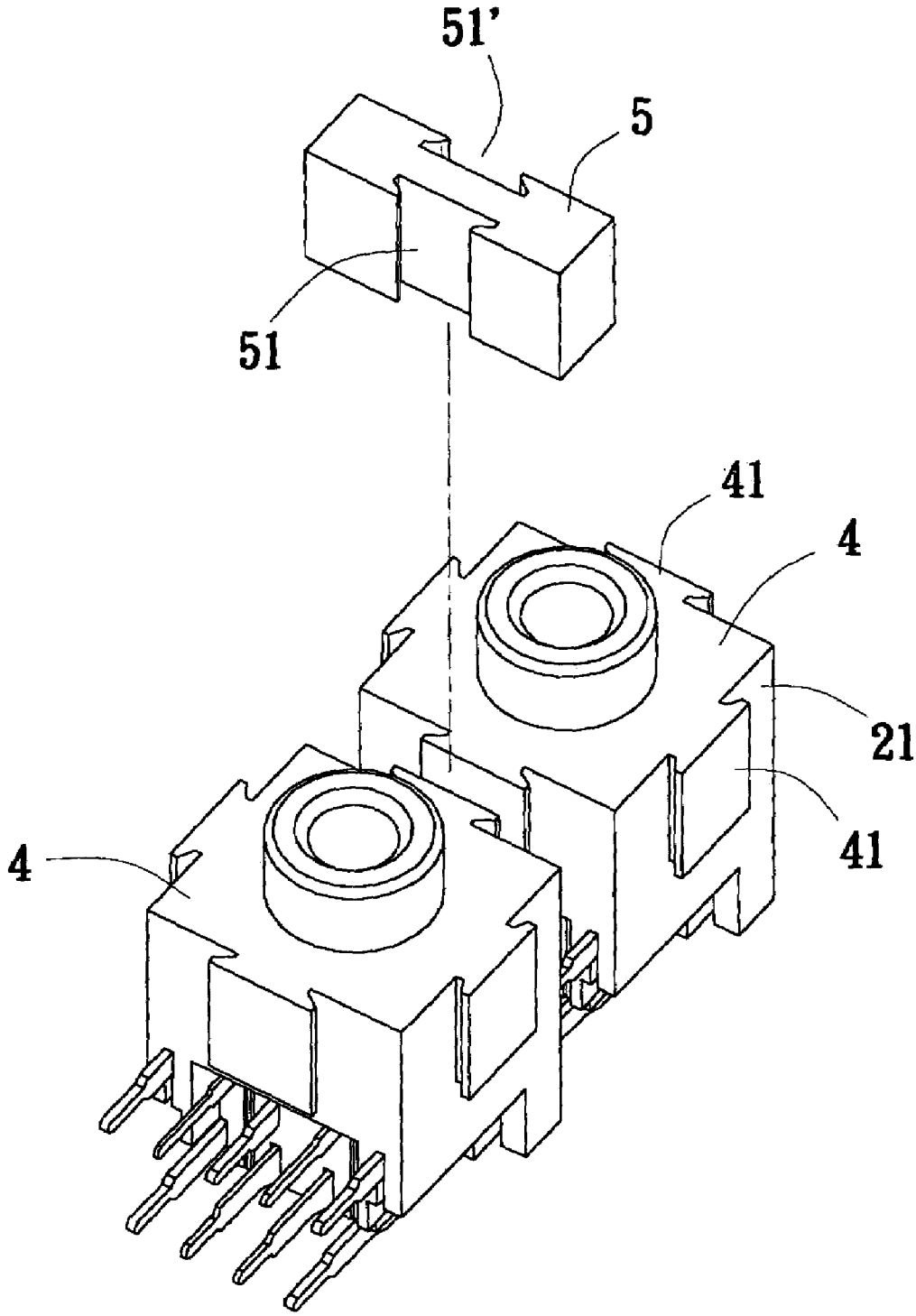
FIG. 5 is an exploded perspective view showing the elements in a second embodiment of the present invention.

Referring to FIG. 5 showing a second embodiment of piled-up audio-source socket 1 of the present invention, wherein four sides 21 of a socket unit 4 are provided each with a dovetail like engaging rail 41 being a first engaging portion; a connecting member 5 is provided on two mutual opposite sides thereof respectively with two engaging grooves 51, 51' in symmetrical allocation forming a shape of a dovetail being a second engaging portion. By connecting of the engaging grooves 51, 51' of the connecting member 5 with the engaging rails 41 respectively of two mutually neighboring socket units 4, the socket units 4 can be assembled in a vertical orientation or a horizontal orientation.

Figure 6:
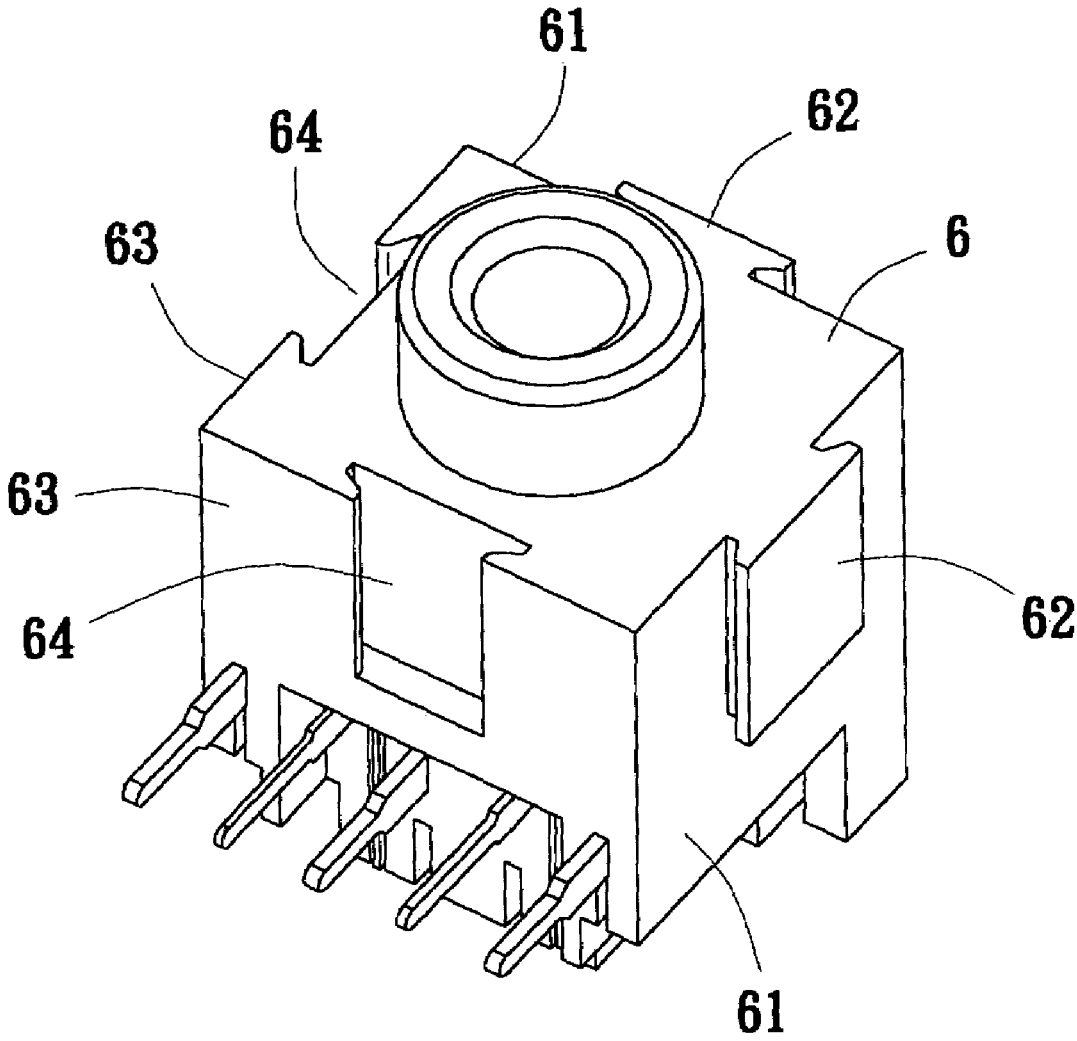
FIG. 6 is a perspective view showing the appearance of a socket unit of a third embodiment of the present invention.
Figure 7:
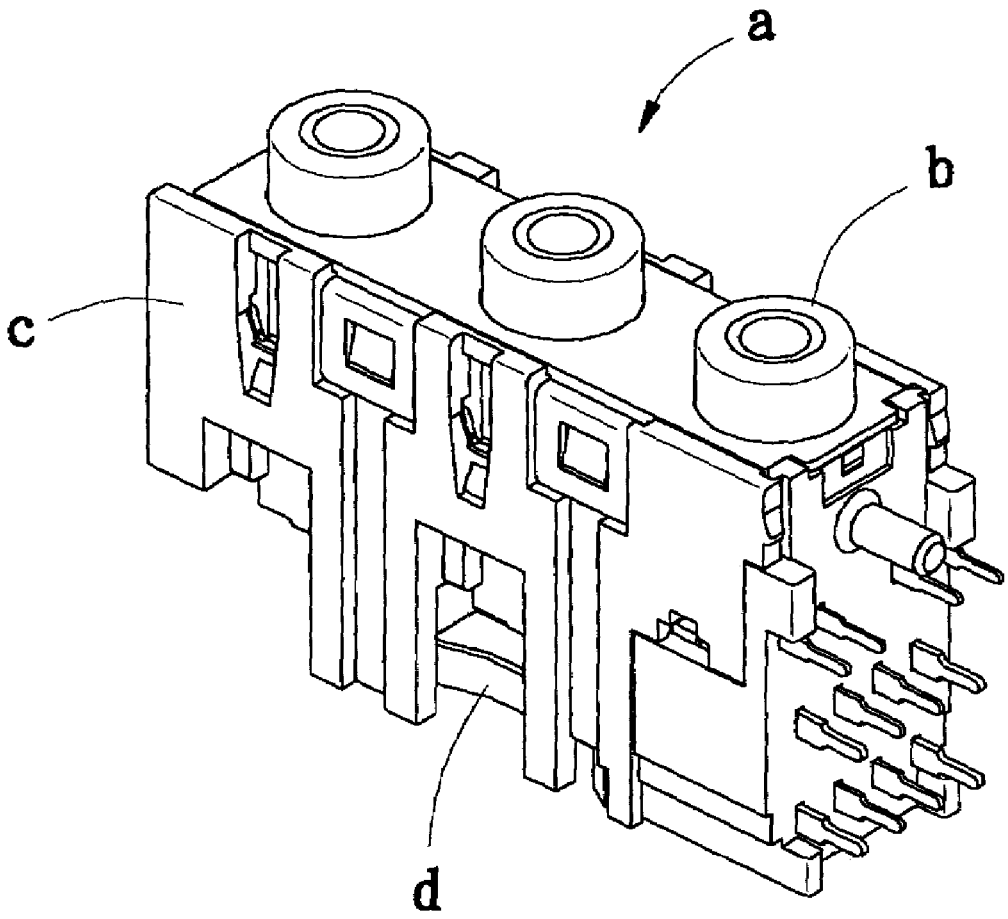
Fig. 7(Prior Art)
FIG. 7 is a perspective view showing the appearance of a conventional three-hole type socket structure.
Figure 8:
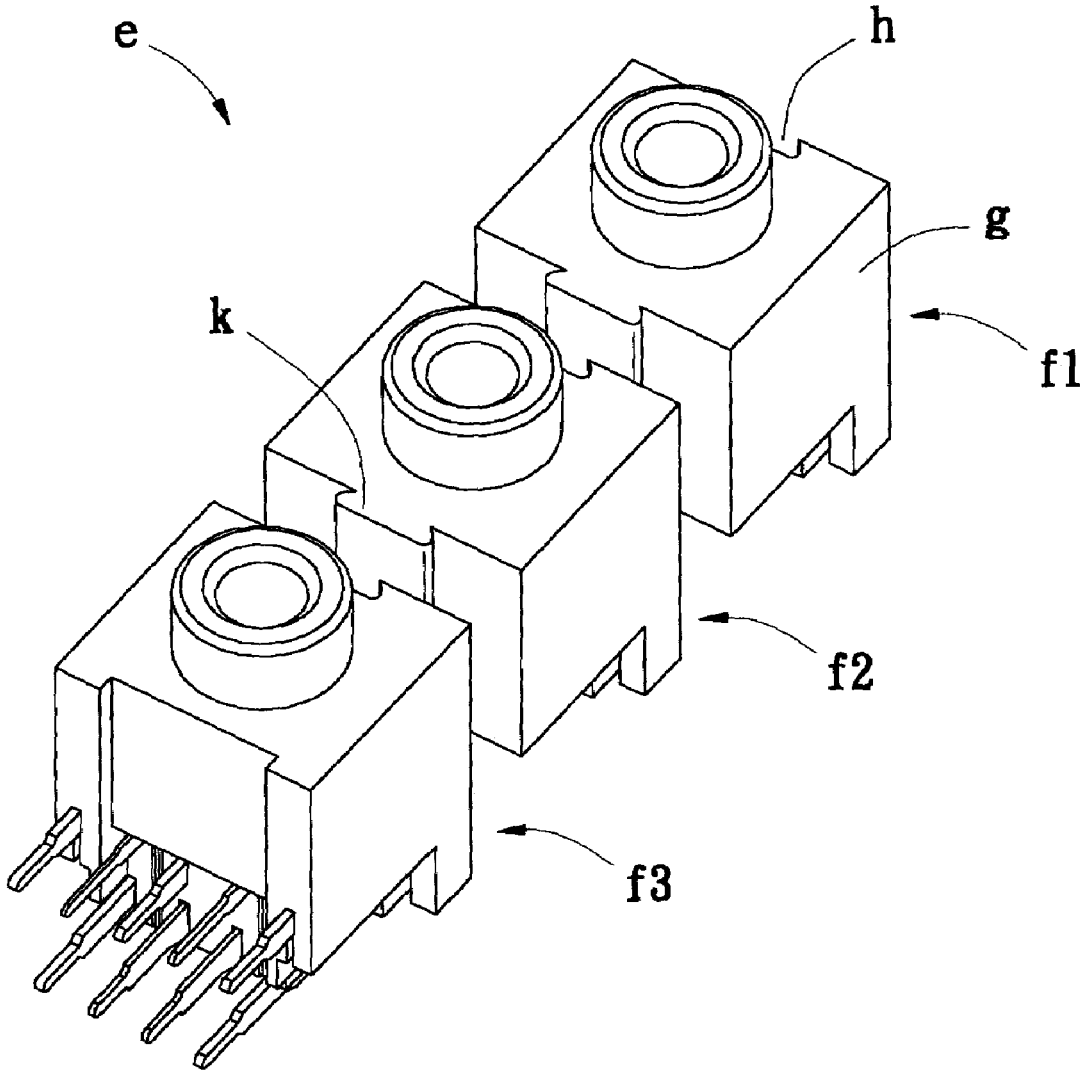
Fig. 8(Prior Art)
FIG. 8 is an exploded perspective view showing the elements in another conventional socket structure.

Referring to FIG. 6 showing a third embodiment of piled-up audio-source socket 1 of the present invention, wherein two mutually neighboring sides 61 of a socket unit 6 are provided each with a protruding dovetail like engaging rail 62 which is connected with an engaging groove 64 provided on either of two mutually neighboring sides on another socket unit 6 in the way like a connecting member 3 being connected with an engaging groove 22 as the first engaging portion of a socket unit 2 of the first embodiment. When the engaging rail 62 on a side 61 of the socket unit 6 is engaged in an engaging groove 64 provided on a side 63 of the aforesaid another socket unit 6, the two mutually neighboring socket units 6 can be connected with each other. When it is required, a plurality of audio-source sockets 1 can be assembled to form any of various shapes, the audio-source sockets 1 are arranged and are flexibly mounted on a circuit board of any of various types of computers and AV equipments.

The present invention thereby has the following advantages:

1. The socket units of the present invention have engaging means provided on their sides to make connection of mutually neighboring ones of the socket units, and can be flexibly arranged to form various shapes for assembling on circuit boards; they not only can be flexibly applied on various types of computers and AV equipments, but also can make allocation of circuits and electronic elements on the circuit boards more mobile.
2. The socket units of the present invention are same in structure, this can reduce the costs of assembling and mold developing during production, thereby quite meets the economic results required.

In conclusion, according to the description disclosed above, the present invention surely can get the expected object thereof to provide a piled-up audio-source socket with a plurality of mutually connectable socket units that can be flexibly connected and arranged to form various shapes.

Having thus described the present invention having high industrial value, what I claim as new and desire to be secured by Letters Patent of the United States are:

1. A piled-up audio-source socket, said audio-source socket being provided on a printed-circuit board and comprises:

a plurality of socket units each having a top, a bottom and four sides and each of said four sides including a first engaging portion and each of said first engaging portions of each of said socket units including a pair of engaging grooves, an open mouth and a bottom stop opposite from said open mouth and wherein each of said grooves has an area-reduced portion;

a generally H shaped connecting member including two mutually opposite sides and an engaging member on each of said two mutually opposite sides and wherein said engaging member is an engaging rail and said engaging rail is constructed and arranged with a middle portion for engaging said area-reduced portion of said engaging grooves with a dove-tail interlocking connection and a lower portion for engaging said bottom stop to make said socket unit assemble in a vertical orientation or a horizontal orientation, and wherein after connection of said socket units, mutually neighboring sides of every two mutually neighboring ones of said socket units are adapted for abut-connecting with each other, and an outer periphery of said audio-source socket thus having flush surfaces.

* * * * *